US007581593B2

(12) United States Patent
Pankratz et al.

(10) Patent No.: US 7,581,593 B2
(45) Date of Patent: Sep. 1, 2009

(54) APPARATUS FOR TREATING FLUID STREAMS

(75) Inventors: Ronald Elrick Pankratz, Houston, TX (US); Lenny Kuslitsky, Houston, TX (US); Andrew Bratushkin, St. Petersburg (RU); Leonid Leshchenyuk, St. Petersburg (RU)

(73) Assignee: AMP Lift Group, LLC, Spring, TX (US)

( * ) Notice: Subject to any disclaimer, the term of this patent is extended or adjusted under 35 U.S.C. 154(b) by 162 days.

(21) Appl. No.: 11/329,654

(22) Filed: Jan. 11, 2006

(65) Prior Publication Data

US 2007/0056729 A1 Mar. 15, 2007

Related U.S. Application Data

(60) Provisional application No. 60/642,588, filed on Jan. 11, 2005.

(51) Int. Cl.
*E21B 36/04* (2006.01)

(52) U.S. Cl. ..... 166/302; 166/60; 166/265

(58) Field of Classification Search ..... 166/302, 166/60, 265, 245

See application file for complete search history.

(56) References Cited

U.S. PATENT DOCUMENTS 4,988,389 A * 1/1991 Adamache et al. ..... 166/302
6,206,093 B1 * 3/2001 Lee et al. ..... 166/60
6,715,546 B2 * 4/2004 Vinegar et al. ..... 166/245

OTHER PUBLICATIONS

International Search Report, International Searching Authority/United States (ISA/US), Patent Cooperation Treaty (PCT), Sep. 25, 2008, United States Patent and Trademark Office (ISA/US)(PCT), Alexandria, Virginia.

International Written Opinion; International Searching Authority/United States (ISA/US), Patent Cooperation Treaty (PCT), Sep. 25, 2008, United States Patent and Trademark Office (ISA/US)(PCT), Alexandria, Virginia.

* cited by examiner

*Primary Examiner*—Jennifer H Gay
*Assistant Examiner*—Brad Harcourt
(74) *Attorney, Agent, or Firm*—Mark A. Tidwell; Jackson Walker L.L.P.

(57) ABSTRACT

An apparatus and method for increasing and regulating temperature, pressure and fluid viscosities of fluid streams found in oil and gas production. Applicant's apparatus regulates and increases fluid temperatures, by and through improved heating apparatus, which may be placed at one or more locations along a wellbore surface flow line, or subsea flow line. The apparatus preferably either heats fluids flowing from the reservoir to the surface, or alternatively, can heat fluids injected from the surface into the reservoir.

4 Claims, 4 Drawing Sheets

APPARATUS FOR TREATING FLUID STREAMS

CROSS-REFERENCE TO RELATED APPLICATIONS

The present application claims the benefit of the filing date of U.S. Provisional Patent Application Ser. No. 60/642,588 filed Jan. 11, 2005.

STATEMENT REGARDING FEDERALLY SPONSORED RESEARCH OR DEVELOPMENT

Not applicable.

FIELD OF THE APPLICATION

The application relates generally to an apparatus for treating a fluid stream flowing inside a pipe or tubing.

BACKGROUND OF THE INVENTION

It is understood in oil and gas production that heating a downhole fluid stream can (a) lower fluid stream viscosity, (b) reduce tubing friction losses, (c) reduce wellhead pressure requirements, (d) reduce or otherwise eliminate the formation of emulsions, and (e) improve pump efficiency, which in turn, can reduce the energy required to deliver a fluid stream to the surface from downhole and can also reduce the load placed on lift system components. It is also known that maintaining the temperature of a fluid stream above the cloud point (the point at which paraffin, hydrates, bitumen, ashphaltines and other complex hydrocarbons precipitate out of the fluid) can eliminate the build-up of restrictive deposits inside a production tubing string that can restrict fluid flow and lower the production rate of a well.

Current techniques used to heat and improve the flowability of fluid streams include resistance heating cables, solid resistance heating elements, induction heaters, and steam or hot oil injection. These techniques often have poor heat transfer characteristics and can lead to significant amounts of energy being lost to the surrounding environment and to non-productive parts of the well.

For instance, with resistance heating cables, which are strapped to the production tubing string to provide heat to the fluid stream inside the tubing during production, a central problem is created because a significant part of the cable is exposed to the surrounding well bore environment. This results in a significant amount of heat energy being lost to the surrounding environment, where it is of little value. Another problem with resistance heating cable systems is that it is extremely difficult to make certain that the heating cable maintains an unbroken contact with the production tubing since gaps where there is no contact will appear at locations where the cable does not lie flat on the tubing. These air gaps significantly lower the efficiency of heat transfer between the cable and the tubing string. Yet another problem with common resistance heating cable systems is that a significant portion of the heat energy, which is delivered to the production tubing, is used to heat the tubing and not the fluid inside. Finally, since none of the heat provided by resistance cable systems is to the fluid below the pump intake, fluid viscosity through the pump is unchanged and there is no benefit to pump performance or efficiency.

Solid resistance heating elements have also been used at the bottom of a production tubing string in order to heat fluid that passes over and around the heating element. The main problem with this configuration is that they have poor heat transfer characteristics due to a lack of fluid flow through the center resulting in internal and surface element temperatures that are significantly higher. The main result is poor efficiency in the heat transfer process. In order to compensate for this poor efficiency, these types of tools must operate with significantly higher surface temperatures, which can lead to coke formation on the heated surfaces. This build-up of coke further limits heat transfer and exacerbates the problem. Finally these heating elements are exposed to the well annulus with no insulating shroud. This means that a significant portion of the heat energy that they provide is lost to the surrounding environment with limited results.

Existing products also found in the marketplace include induction heaters, which warm the production casing or tubing using induced current in order to warm the production fluid stream inside the well bore. The main problem with induction heaters is that the clearance between the powered induction coil and the casing or tubing must be very small in order to maintain minimum levels of energy efficiency. Since the induction coil in most designs is located in the path of the production fluid stream, they often add significantly to pressure losses in the fluid stream defeating their purpose. In addition, placing an electrical current inside any component of a producing well such as the tubing or casing will significantly increase the corrosion rate and may cause premature failure.

Additional products found in the marketplace include steam or hot fluid oil injection products and methods where heated fluid or steam is injected into the well from the surface in order to remove wax and paraffin build-up or to increase the temperature of the fluid contained in the well bore or reservoir. The main problem with steam or hot oil injection products is that significant levels of heat energy are lost in these processes to non-productive parts of the well such as the casing, annulus and portions of the earth in contact with the casing that are not a part of the reservoir. In addition, the surface infrastructure required for permanent steam injection takes considerable space on the surface making this application undesirable in most offshore applications and populated areas.

An apparatus is needed that can increase the temperature and better regulate and improve the flowability a fluid stream.

SUMMARY OF THE INVENTION

It is an object of this invention to provide an apparatus and methods of use that regulate and preferably provide regulated increases in the temperature of a hydrocarbon stream produced from an oil and gas well or to preferably increase the temperature of fluid streams introduced into a well for instance light oil, diluents, or any other liquid including water. It is an object of the invention to enhance the efficiency of fluid stream delivery to the surface by conventional lift methods or in a free flowing well, lower operating costs and/or higher producing rates. The invention also preferably features surface controls that assist with regulating, sensing and measuring fluid stream temperature, pressure, rate and other parameters of the lifting system. It is an object of this invention to provide an apparatus and methods of use that regulate temperature to a hydrocarbon fluid stream produced from an oil or gas well or to regulate temperature of fluid streams introduced into a well, for instance in injection operations. It is an object of this invention to enhance efficiency of stream delivery to the surface by conventional lift methods or in a free flowing well, at lower operating costs and at higher producing rates. It is an object of the invention to provide these and other benefits by and through methods and use of an apparatus preferably featuring uniquely adapted heating chamber(s), mixing chamber(s) and preferable shrouds as further shown and described in the specification and figures of this application. The apparatus may be located at a plurality of locations along a wellbore and is preferably used to regulate temperatures of fluids flowing from a reservoir to the surface, or alternatively from the surface to the reservoir. The invention also preferably features surface controls that assist with regulating, sensing and measuring fluid temperatures.

Another preferable object is to produce an apparatus that can cost effectively provide regulated temperature increases downhole to a fluid stream injected into a well (injection or production) from the surface in order to clean up the near well bore completion zone and/or remove or decrease skin damage in order to restore or increase well productivity. Another preferable object of this invention is to produce an apparatus that can cost effectively provide regulated temperature increases downhole to a fluid stream injected into an injection well located in a hydrocarbon producing field from the surface in order to improve hydrocarbon delivery from the reservoir to one or more producing wells.

Another preferable object of this invention is to provide apparatus that may be permanently installed in a producing hydrocarbon well that can cost effectively provide regulated temperature increases to a fluid stream downhole, whether said fluid stream is injected from the surface into a producing well, or alternatively produced from a well. It is well understood that injecting hot water, oil or steam from the surface using an injection well into a hydrocarbon reservoir can lower the viscosity of deposits in the reservoir and improve delivery to nearby producing wells. Since significant temperature losses occur in this fluid stream from any surface heating facility to the reservoir, it is clear that providing heat to the fluid stream downhole near the target producing zone in the reservoir will result in energy savings.

Another preferable object of this invention is to reduce or eliminate the deposits of waxes, paraffins and other hydrocarbon compounds which often form in the near well bore producing zone due to changes in fluid pressure and temperature as hydrocarbons are produced.

A further preferable object of this invention is to eliminate the need to periodically inject hot fluids into the near well bore area to eliminate the deposits of waxes, paraffins and other hydrocarbon compounds which often form in the near well bore producing zone due to changes in fluid pressure and temperature as hydrocarbons are produced.

Another preferable object of this invention is to reduce or eliminate the need for existing devices to heat the fluid on the surface, and thus lose efficiency due to heat losses during delivery from the surface to downhole or require removal of the lift system in order to be installed.

A further preferable object of this invention is to provide a permanently installed downhole apparatus which can heat fluid flowing in either direction, and which would have a significant advantage over existing processes since it would eliminate the need for workover and provide benefits during both (producing and injecting) phases of operation.

Another preferable object of this invention is to produce an apparatus that accurately and cost effectively regulates increases in the temperature of a hydrocarbon production fluid stream in order to reach and maintain a selected fluid stream viscosity in order to reduce viscous friction losses inside the downhole and surface production tubing and optimize the operating efficiency of the artificial lift system.

Another preferable object of this invention is to produce an apparatus that accurately and cost effectively regulates increases in the temperature of a hydrocarbon production fluid stream and keeps the temperature of the hydrocarbon production above the temperature at which paraffin and hydrates in the production will precipitate out of the liquid and form on surfaces, restricting flow and increasing pump head requirements.

Another preferable object of this invention is to produce an apparatus that accurately and cost effectively regulates increases in the temperature of a hydrocarbon production fluid stream to keep paraffin and hydrates in solution during its transport to the stock tank on the surface.

Another preferable object of this invention is to produce a device that accurately and cost effectively regulates increases in the temperature of a hydrocarbon production fluid stream to destabilize emulsions that may be formed as a result of mixing by a pump or other artificial lift system.

Another preferable object of this invention is to produce a device that allows the total power required to transport heavy oil from the reservoir to the surface and from the well head to the stock tank to be held at a minimum.

Another preferable object of this invention is to produce a device that allows increased production rates from existing wells by substituting heat energy for mechanical pumping energy, and to produce a device that allows increased production rates from existing wells by substituting heat energy for lift pressure in free-flowing or gas lifted wells.

Another preferable object of this invention is to produce a device that keeps an accurate record of the downhole and surface pressures, temperatures and other parameters and the electrical energy used by the heating system during the production of the hydrocarbons from a well.

Another preferable object of this invention is to produce a device that can remain permanently installed in the well and that does not need to be removed during the production process Another preferable object of this invention is to produce a device that communicates between sensors located both at the surface and downhole to keep the temperature of the hydrocarbon production within a specified range.

Another preferable object of this invention is to produce a device that is robust, cost effective and has a long service life after being installed in a wellbore.

Another preferable object of this invention is to produce a device that can be economically installed on a single or on a few wells, versus surface located steam injection facilities that are capital intensive and thus whose use is restricted to larger fields.

Another preferable object of this invention is to produce a device that can be used as a novel form of artificial lift, where heat energy is used instead of mechanical energy such as from a pump or instead of a gas lift system. These and other objects of the invention will be appreciated by those skilled in the arts.

Figure 1A:
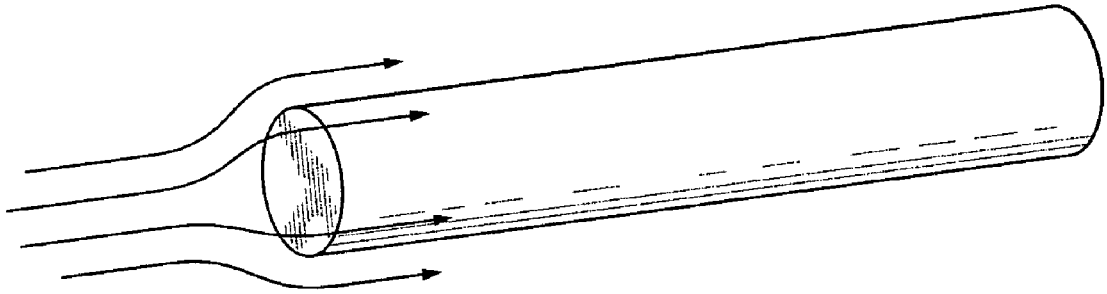
FIG. 1A illustrates a perspective view of a solid heating member, which is an optional component of the apparatus.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present application relates to an apparatus suitable for treating fluid streams by:

(a) transferring temperature increases to fluid streams, whether the fluid stream is produced downhole, or is injected from the surface;
(b) regulating, and increasing temperature of the downhole fluid stream;
(c) being installed downhole in a wellbore whether permanently or temporarily;
(d) transferring temperature increases to fluid flowing in any direction; and
(e) reaching and maintaining a selected fluid stream viscosity.

The present application also relates to a system suitable for:

(a) recording downhole pressures and temperatures;
(b) recording surface pressures and temperatures;
(c) recording and monitoring power usage of the apparatus during treatment of a fluid stream; and
(d) communicating surface and downhole fluid stream temperature and pressure and other parameters to the surface in order to monitor the effectiveness of the heating regime.

In oil and gas production, the apparatus is particularly advantageous for treating fluid streams to:

(a) lower fluid viscosity by heating fluid streams;
(b) maintain complex hydrocarbon compounds in solution;
(c) eliminate the necessity of removing lift systems to install known surface heating devices;
(d) maintain the fluid stream temperature above the temperature at which paraffin and hydrates precipitate out of the fluid stream;
(e) maintain the paraffin and hydrates in the fluid stream solution during transport of the fluid stream to a stock tank located on the surface;
(f) maintain the fluid stream temperature to destabilize emulsions that can be formed as a result of mixing by a pump or other artificial lift system; and
(g) increase production rates from existing wells by substituting heat energy for mechanical pumping energy.

Other advantages of the apparatus include but are not necessarily limited to the ability to treat fluid streams in oil and gas production brought to the surface by conventional lift methods or fluid streams in free flowing wells; the ability to eliminate the necessity of periodic injections of hot fluids into near well bore areas to remove deposits of waxes, paraffins and other hydrocarbon compounds that can form in near well bore producing zones resulting from changes in fluid pressure and temperature during hydrocarbon production; the ability to minimize the power requirements for producing heavy oil from a reservoir to the surface and from a well head to a stock tank; and the ability to eliminate the necessity of surface located steam injection facilities that are capital intensive and whose use is restricted to large production fields.

In a first embodiment, the treatment apparatus comprises (1) a heating member for transferring temperature increases to at least one fluid stream, and (2) a mixing chamber in fluid communication with the heating member to mix the heated fluid. In addition, the amount of heat being transferred to the fluid stream from the apparatus can be programmed, monitored and adjusted. The apparatus according to the present application will be described in more detail with reference to the embodiments illustrated in the drawings. The drawings are illustrative only, and are not to be construed as limiting the invention, which is defined in the claims.

Figure 1B:
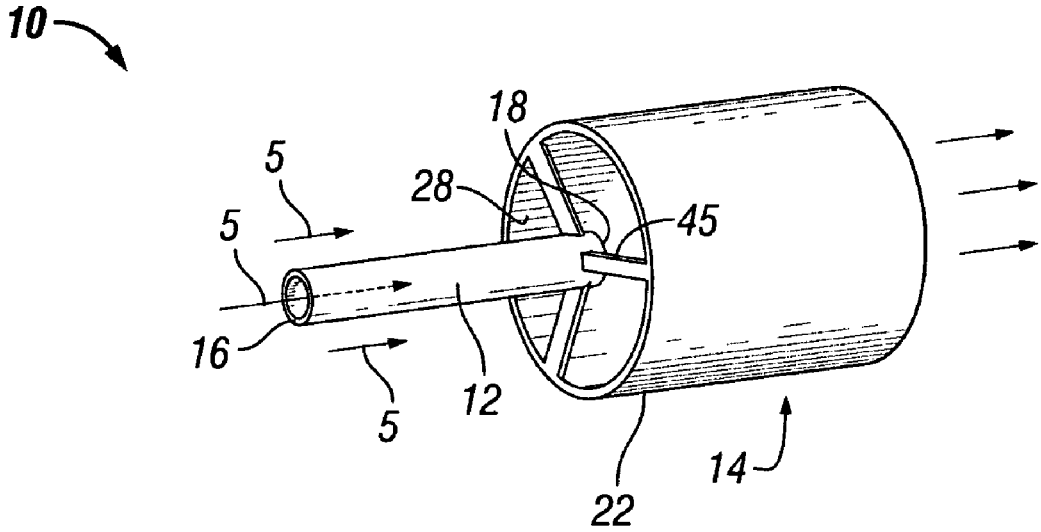
FIG. 1B is one depiction of treatment apparatus components, including a heating member and a mixing chamber.
Figure 1C:
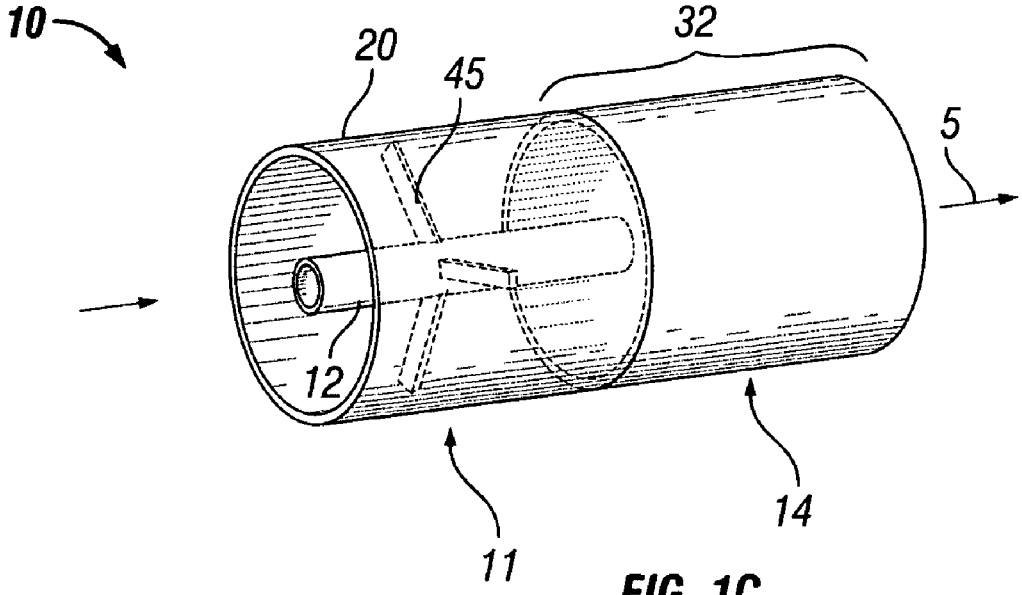
FIG. 1C illustrates a perspective view of the apparatus including a heating chamber, heating member, mixing chamber and a shroud enveloping the apparatus.
Figure 1D:
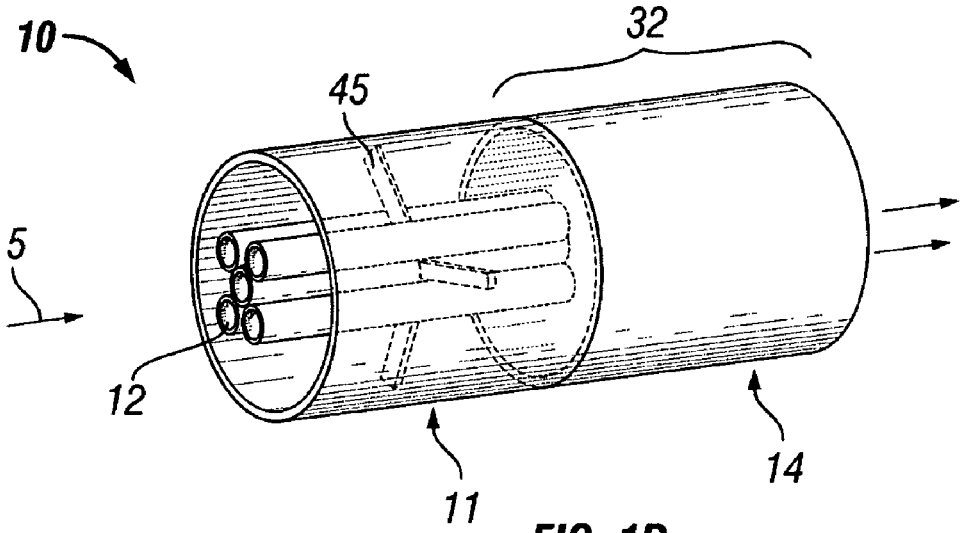
FIG. 1D illustrates a perspective view of the apparatus including a plurality of heating members, and a mixing chamber formed from and enveloped by a shroud.

In a simple embodiment of the invention, a heating chamber 11 will contain a single heating member 12 contained within a shroud 32 that forms the heating chamber 11 wall. The heating member 12 will be fixed to the shroud 32 by fastening means 45, which might include but are not limited to welds, pre-fabricated metal shapes, spokes, or other connectors able to withstand downhole conditions. A shroud 32 makes certain that fluid in the fluid stream passes near to a heating member 12 in order to facilitate heat transfer to the fluid stream and also isolates and insulates the fluid stream from the well bore environment. Ideal forms for heating elements include but are not limited to a thin plate or plates, a solid member or rod (FIG. 1A), a simple hollow tube (FIG. 1B), or a complex hollow tube (FIG. 1D) since these shapes expose a higher percentage of their surface to the fluid stream and improve heat transfer. A preferable benefit is to maximize heated surface exposed to the fluid stream while maintaining a low-pressure drop. Pressure drop is a direct function of the surface area perpendicular to the direction of fluid flow. FIG. 1B demonstrates preferable components of a first embodiment of the apparatus 10, namely a heating member 12, and at least one mixing chamber 14, which as seen if FIG. 1C is in fluid communication with heating chamber 11. A single heating member(s) 12 preferably comprises a solid heating device, passageway or tube that a fluid stream passes through or over and where one of more of the walls of the heating member(s) 12 are heated in order to provide a heat transfer surface. In its simplest form of design, a heating member 12 preferably comprises an electrically heated member 12, solid element or hollow structure contained inside the production tubing as shown where fluid passes through and/or around the heating member 12. A solid heating member 12 is depicted in FIG. 1A where the fluid passes only around an outside diameter of the heating element. In a hollow embodiment of heating member 12 (FIG. 1B), there is approximately twice the surface area per foot of length (inner and outer surfaces) exposed to the fluid stream as a respectively sized solid element (outer surface only), therefore, this is a preferable embodiment given that more heat energy will be transferred to the fluid stream than with a solid heating element. With the hollow embodiment, the internal temperature of the heating member walls will be lower under the same operating conditions. Stated another way, this means that in terms of heat transfer capability the hollow heating member 12 embodied in this design is more energy efficient method for fluid stream heating than a solid element. Therefore, a main benefit of a hollow version of heating member 12 is that the fluid stream passes through and around an enclosed area where the sides are comprised of one or more directly (resistance) or indirectly (induction) heated surfaces, which are exposed to the fluid stream on all sides. When fluid passes over any heated surface, the temperature of the portion of the fluid stream immediately adjacent to the heated surface is highest and temperatures further away from the heated surface are lower. Effectively, a fluid stream separates into layers where the fluid closest to the heated surface is warmer and flowing faster than fluids further away from the heated surface. This means that in order to optimize heat transfer rates close attention must be paid to the maximum distance that any portion of the fluid stream may take around the heated surface. If the distance is too large, the result is inefficient and results in uneven temperature regulation. With a heating member 12, it is possible to precisely control this distance, particularly when one preferable mode is used employing multiple heating members 12 in parallel, as depicted in FIG. 1D.

In oil and gas production, as fluid passes near or contacts a heated surface, the temperature of that portion of a fluid stream immediately adjacent the heated surface is increased to about the temperature of the heated surface, while the temperature of that portion of the fluid stream further from the heated surface is increased to a lesser degree. Once heated, the fluid stream separates into layers wherein the fluid layer (s) closest to the heated surface comprise a higher temperature and lower viscosity than fluid layer(s) further away from the heated surface. The presence of multiple fluid layer(s) can lead to viscous friction losses inside the downhole and surface tubing string and reduce the operating efficiency of any artificial lift system used during production. The present apparatus 10 overcomes the above concerns by (1) transferring temperature increases to a fluid stream 5, and (2) mixing the heated fluid stream 5 prior to dispensing the fluid stream 5 from apparatus 10. In other words, the two or more heated fluid layers can be mixed together within apparatus 10 to equalize the temperature, viscosity, and pressure of fluid stream 5, and otherwise remove the layers from the fluid stream 5.

Following completion of a wellbore, apparatus 10 is transported to a downhole location by attaching apparatus 10 to tubing string 34 as tubing string 34 is being placed into the wellbore. A shroud 32, which is preferably a continuous tube forming heating chambers 11 and mixing chambers 14, is connected directly to the tubing string 34. The apparatus 10 is preferably threaded just like production tubing, but it may also be attached to the tubing string 34 by other means, including but not limited to bolts, welds, or shrink fit.

Figure 1E:
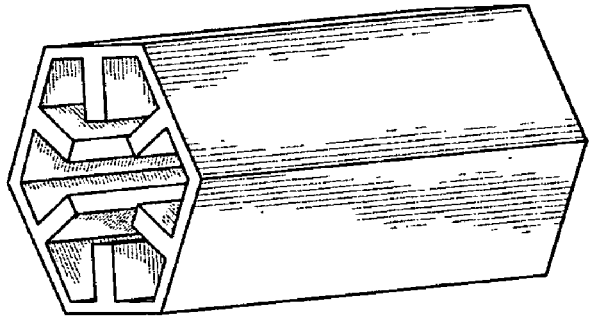
FIG. 1E depicts one embodiment for an enclosure of either a heating or a mixing chamber featuring preferable obstructions or fins that may be used in embodiments of the treatment apparatus to manipulate fluid streams or to enhance heat transfer and/or mixing of the fluid stream.
Figure 2A:
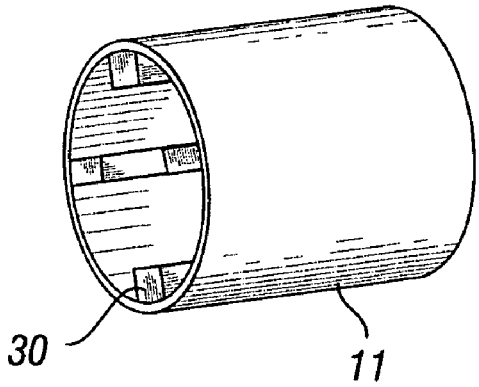
FIG. 2A illustrates a perspective view of a preferable enclosure of a heating or mixing chamber including obstructions projecting from an inner surface of a chamber wall.

A heating member 12 may have an infinite number of shapes varying from the round tube in FIG. 1B to a tube with irregular or polygon surfaces (See FIG. 1E), and with or without obstructions 30 as depicted in FIG. 2A. Individual heating members 12 may be assembled in a treatment apparatus 10 in series (See FIG. 2B) or in parallel. In a parallel assembly, the fluid stream must pass through or around at least one of the individual heating members 12.

Each of heating members 12, heating chambers 11 mixing chamber 14, and shroud 32 can be constructed of any material durable enough to withstand various treatment conditions including but not necessarily limited to chemical environments of varying pH and corrosivity, varying temperatures, varying pressures, and other loads placed upon apparatus 10. Suitable materials for the heating chambers 11, mixing chambers 14, heating members 12 and shroud 32 formed therefrom include but are not limited to steel, aluminum, plastics, steel and other metal alloys, ceramics, rubber, pvc, and combinations thereof. A particularly advantageous and preferable design for heating and mixing chamber and shroud is alloy steel configured to withstand pressures up to 25 MPa or 25,000,000 Pascals and temperatures up to 350 degrees Celsius. Each of heating member(s) 12, heating chambers 11 and mixing chamber 14 can also be constructed of materials including but not necessarily limited to those materials resistant to chipping, cracking, excessive bending and reshaping as a result of weathering, heat, moisture, other outside mechanical and chemical influences or that are commonly known in the downhole tooling industry.

Heating chamber 12 can include a solid construction, or in the alternative, heating chamber 12 can be defined by at least one opening therethrough and include at least one outer surface and at least one inner surface thereby increasing the surface area for transferring temperature increases to a fluid stream 5. Herein, the term "transferring temperature increases" refers to apparatus 10 increasing the temperature of (e.g. transferring heat to) at least one fluid stream 5 from a first temperature prior to treatment of fluid stream 5 by apparatus 10 to a second temperature reached either during or immediately following treatment of fluid stream 5 by apparatus 10. Herein, the term "fluid" refers to any liquid or gas flowable through and around (1) conventional tubing and (2) the apparatus including at least one heating chamber. Likewise, the fluid can comprise any pressurized conditions and viscosity characteristics suitable to maintain flowability through the tubing and apparatus 10. The present apparatus 10 is therefore configured to treat fluids including but not necessarily limited to hydrocarbon based liquids and gases, and water based liquid and gases.

Typical downhole temperatures in oil wells will range from 50° to 95° Celsius. Typically, apparatus 10 can preferably increase the temperature of any given fluid stream 5 up to about 180° C. Of course, the increase in temperature to any given fluid stream 5 depends not only on the amount of heat being transferred to fluid stream 5 from apparatus 10, but also on the starting temperature of the fluid stream 5 prior to treatment with apparatus 10.

The length of the treating apparatus 10 is a function of the flow rate desired temperature change that is expected from the well. Ultimately, the diameter or width of apparatus 10 is determined by the diameter of the hole and/or casing where apparatus 10 is to be positioned during operation. Although apparatus 10 is not limited to any particular size and shape, the length of a one preferable heating chamber 11 on preferable embodiment is approximately 3 feet, with an approximate length of a mixing chamber 14 of 1.5 feet. Although a variety of sizes of treating apparatus 10 are preferable, one preferable range of apparatus 10 lengths (including heating and mixing chambers) is in the range of 30 feet to 120 feet.

As shown in FIG. 1B, heating member 12 preferably comprises an opening including a first end 16 configured to receive a fluid stream 5 and a second end 18 configured to dispense fluid stream 5. Second end 18 is configured to be in fluid communication with mixing chamber 14. As shown in FIG. 1C, heating member 12 is preferably enclosed by shroud 32, which shroud 32 forms a wall of heating chamber 11. The portion of shroud 32 forming the wall of heating chamber 11 is alternately referred to as enclosure 20 herein. Enclosure 20 is also configured preferably to envelop the heating member (s) 12 of treatment apparatus 10.

Heating chamber 11 comprises one or more heating members 12 aligned in series or in parallel, or both. In addition, heating chambers 11 can include a plurality of configurations. Where heating chamber 12 comprises a tubular configuration, the wall of heating chamber 12 can comprise a plurality of shapes including but not necessarily limited to round, oval or multi-sided shapes including but not necessarily limited to rectangular, polygonal, and irregular shapes. Heating chamber 12 can also include obstructions 30 in similar fashion as mixing chamber 14 projecting from the inner surface of the heating chamber 12 wall, as shown in FIGS. 1E and 2A.

Even though heating members 11 and mixing chambers 14 can be arranged in any combination and aligned in series or in parallel, it is advantageous for apparatus 10 to be configured so that at least one heating member 12 transfers heat to fluid stream 5 prior to the fluid stream 5 entering a final mixing chamber 14. For example, a fluid stream 5 may flow from a mixing chamber 14 to a heating member 11 then to another mixing chamber 14; a fluid stream 5 may flow through a series of heating members 11 to a series of mixing chambers 14; or a fluid stream 5 may cycle through multiple heating member/mixing chamber combinations, so long as long as fluid stream 5 flows lastly from a mixing chamber 14 prior to delivery of fluid stream 5.

As depicted in FIG. 1B-D, a principal component of treatment apparatus 10 is a mixing chamber 14. A mixing chamber 14 is a second section of the treatment apparatus 10, which is in fluid communication with the heating member 12 and heating chamber 11. The mixing chamber(s) 14 receive fluid streams flowing over and through one or more heating chambers 11 and heating members 12 to provide a space where the fluid is preferably equalized in terms of temperature and pressure. In terms of structure, this mixing chamber 14 is preferably an unheated passageway that may or may not contain vanes, obstructions 30 or fins (FIG. 2A) to rotate and mix the fluid (a heated mixing chamber might also be used). In its simplest form of design, a mixing chamber 14 consists of a hollow tube or chamber that receives fluid flow from one or more heating members 12 in a heating chamber 11. The mixing chamber 14 should have sufficient length to "mix" these multiple streams in order to equalize the temperature and pressure. The result is that multiple fluid streams from individual fluid paths originating within the heating members 12 and heating chambers 11 are converted into a single fluid steam with a single temperature and pressure. This "mixing" is beneficial to the overall efficiency and operation of a heating element since it eliminates differences in temperature and pressure between individual fluid streams that have passed through differing paths in the heating chamber 11 due to differences in cross sectional and heated surface area. "Mixing" is also beneficial since it reduces the impact if any fluid path inside a heating chamber 11 becomes plugged with foreign material during operation. This makes it possible to design heating chambers 11 with small or complex fluid paths that may be more susceptible to plugging than if there were no mixing chamber 14 included in the design.

Mixing chamber(s) 14 receive fluid streams from heating chamber(s), however, they may be assembled in variable combinations. For example, a mixing chamber 14 may either deliver the fluid stream to another heating chamber 11 where multiple heating members 12 are assembled in series (FIG. 2B) or directly to the production tubing for delivery to the surface. Further, mixing chambers 14 may include fins, or obstructions 30 attached to the inner surface to promote mixing of the fluid and equalization of temperature and pressure (See FIGS. 2A or 1E). Mixing chambers 14 may also vary from a regular cylindrical shape and incorporate a more complex surface such as a Venturi design to achieve desirable fluid stream pressure objectives.

Figure 2B:
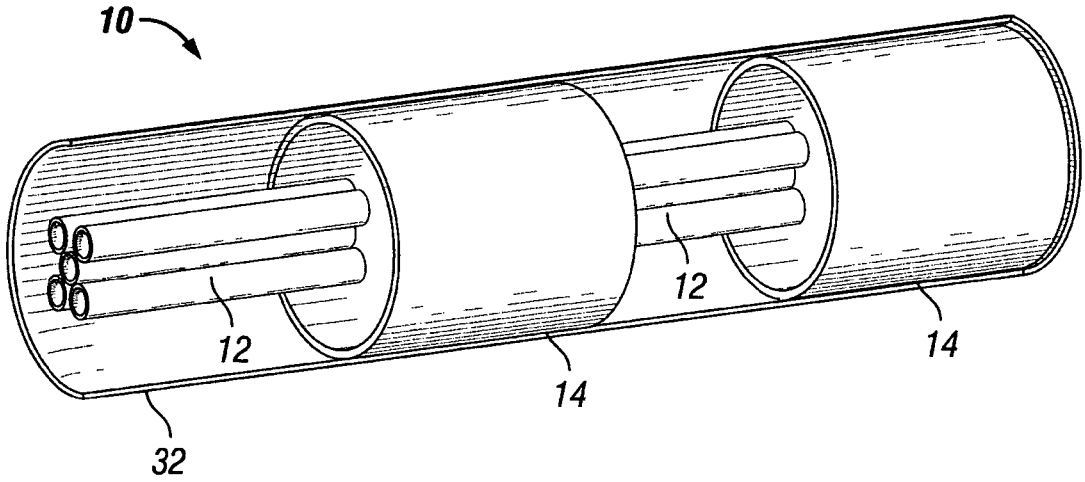
FIG. 2B illustrates a perspective view of the apparatus in a casing including a cross-section of a shroud enveloping the apparatus, and further illustrates a preferable embodiment with mixing and heating chambers arranged in a series. Heating members are depicted in parallel form.

Mixing chamber 14 is enveloped by a shroud 32, which shroud 32 portion over mixing chamber 14 also defines and is referred to herein as enclosure 22. Mixing chamber 14 includes an enclosure 22 defined by an inlet 24 for receiving fluid stream 5 from heating chamber 11, and has outlet 26 for dispensing fluid stream 5 from mixing chamber 14. Enclosure 22 forms a reservoir between inlet 24 and outlet 26 configured to substantially equalize the viscosity, temperature and pressure of fluid stream 5. In addition, enclosure 22 includes at least one outer surface exposed to the ambient environment, and at least one inner surface exposed to the reservoir of mixing chamber 14. Suitably, the enclosures of heating chamber 11 and mixing chamber 14 are configured to sealably attach or be formed together for optimum fluid transfer. As depicted in FIG. 2B, a treatment apparatus 10 may preferably comprise one or more heating chambers 11 connected to one or more mixing chambers 14, preferably enclosed by a shroud 32 so that a fluid stream 5 passes through at least one heating member 11 and one mixing chamber 14.

Enclosure 22 can also comprise a plurality of shapes including but not necessarily limited to round, oval or multi-sided shapes. The reservoir of mixing chamber 14 can further include one or more inner walls 28 forming flow channels therebetween and/or include one or more obstructions 30 to mix the fluid received from heating chamber 11. Suitable obstructions 30 include but are not necessarily limited to protrusions that project out from the inner surface of mixing chamber 14, such as are preferably depicted in FIGS. 1E and 2A.

FIG. 2B depicts an important preferable feature of the treatment unit 10, namely, a shroud 32. The shroud 32 is another preferable feature of the treatment apparatus and is a covering that surrounds the heating 11 and mixing 14 chambers in order to provide structural integrity and to assure that a fluid stream passes through and around the heating member (s) 12. The shroud 32 also provides beneficial insulation between the heated fluid stream 5 and the ambient environment, limiting heat loss and improving operating efficiency. A shroud 32 preferably comprises a tube assembled over the outside combination of heating 11 and mixing 14 chambers in order to contain fluid flow, to provide structural integrity, and to reduce heat loss to the environment. Since a heating member 12 preferably allows fluid to flow over both its internal and external surfaces, some type of shroud 32 is preferable to contain and direct the fluid flow. The shroud 32 in this design contains the assembly consisting of one or more heating 11 and mixing 14 chambers and provides structural integrity to the completed assembly (FIG. 2B). Finally, the shroud 32 provides temperature insulation between the heated fluid stream and the environment where it is installed.

In the simplest preferable configuration, a shroud 32 may consist of any thin wall material where the primary function is to direct fluid flow through the heating 11 and mixing 14 chambers without regard to structural or insulating properties. In another preferable configuration, a shroud 32 may be constructed of heavy wall tubing in order to provide structural support to the assembly of heating 11 and mixing 14 chambers and to equipment that may be installed below this assembly. The material used in the shroud 32 may be selected to maximize heat insulation between the production fluid stream and the environment where it is used.

Figure 3:
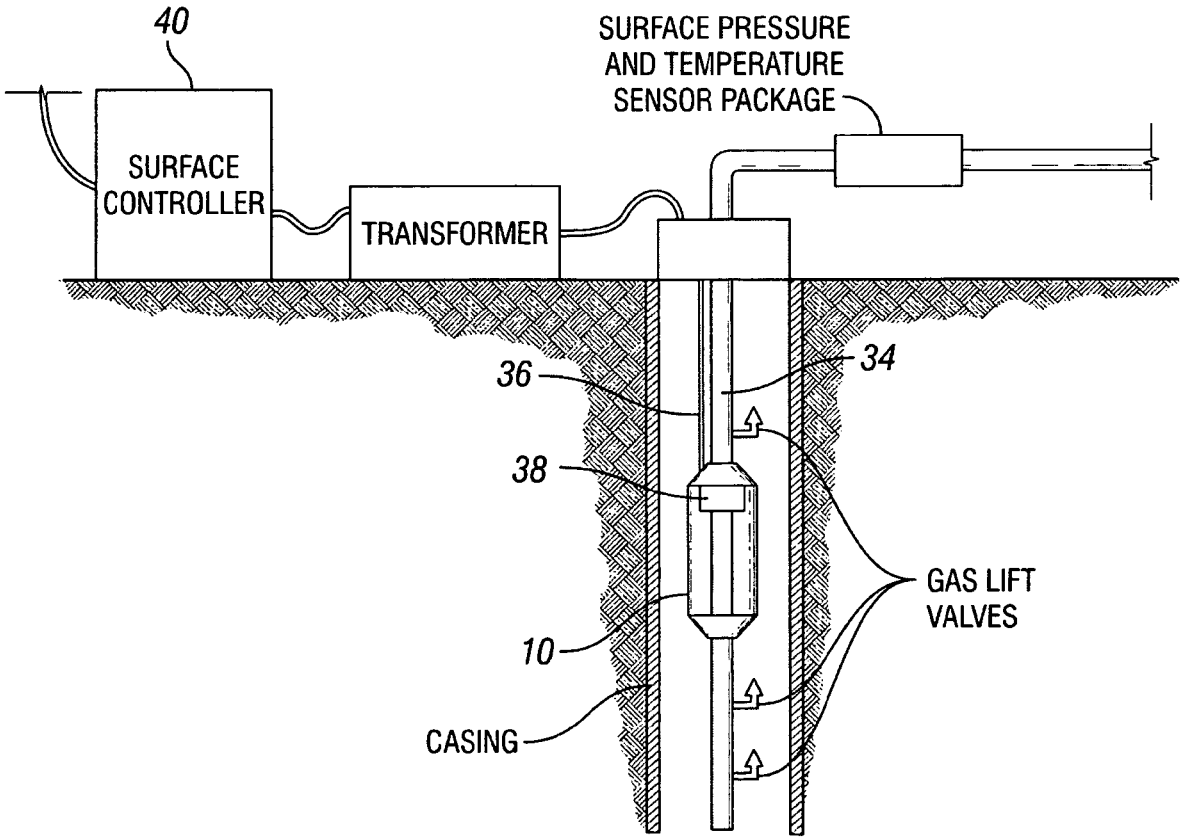
FIG. 3 illustrates a production system and side view of a treatment apparatus for oil and gas production located at a midpoint along the tubing string.

Apparatus 10 can further comprise a shroud 32 configured to envelop at least part of apparatus 10. Suitably, shroud 32 is configured to (a) seal and direct fluid flow within apparatus 10, (b) provide structural integrity to apparatus 10, and (c) reduce heat lost to the ambient environment. As shown in FIG. 3, shroud 32 is preferably configured to envelop up to 100% of the length of treatment apparatus 10. In a particularly advantageous embodiment, shroud 32 envelops at least heating member 12. Furthermore, shroud 32 can be comprised of any material including but not necessarily limited to thin wall materials and heavy wall materials. Thin wall materials can be defined as those materials configured to direct fluid flow through apparatus 10 without regard to structural or insulating properties of shroud 32. Heavy wall materials can be defined as those materials that provide structural support to apparatus 10 and/or equipment that can be installed below apparatus 10 downhole. Shroud 32 can further be coated with material(s) to assist with heat insulation.

As depicted in FIG. 3, the treatment apparatus 10 preferably features a surface controller 40. The surface controller 40 regulates voltage supplied to the downhole treatment apparatus 10 in response to signals received from the treatment apparatus 10 sensors 38, and using electronic components including but not limited to thyristors or Silicon Controlled Rectifiers (SCRs). This regulation is controlled by a microprocessor, which is a major component of the surface controller 40. The surface controller 40 preferably stores information about well conditions (temperatures, pressures, etc.) for future access and so that engineers may monitor and analyze conditions. Switchboards are commonly used in many applications to control the power delivered to a motor or other electrical device. This system of sensors 38 and regulators preferably maintains temperatures of fluid streams 5 within plus or minus a degree Celsius of a target temperature, although this preferable level of sensitivity is not meant to be limiting of the invention, which may also regulate at lesser sensitivities. These devices ordinarily include some form of on/off switch and some form of overload protection such as fuses. A surface controller 40 is a specialized form of switchboard that preferably provides three additional components not normally found in a switchboard—an electronic device that can modify the voltage of multi-phase power, a device to receive and interpret data received from the downhole sensor 38, and a microprocessor with software to control the operation of the voltage modifying device in order to achieve the desired results. For this application, the primary objective is to accurately and continuously adjust the voltage delivered to the treatment apparatus 10 in response to signals received from a sensor 38 using electronic voltage regulation components as directed by the program in the microprocessor or as manually directed. There are a number of different known alternatives to continuously electronically regulate voltage including Thyristors, SCRs and other devices. Any of these devices may be suitable for use in a surface controller 40. Similarly, there are a large number of known alternative microprocessor designs and associated control software to control the operation of a Thyristor or SCR. Any of these devices may be suitable for use in a surface controller 40.

Figure 4:
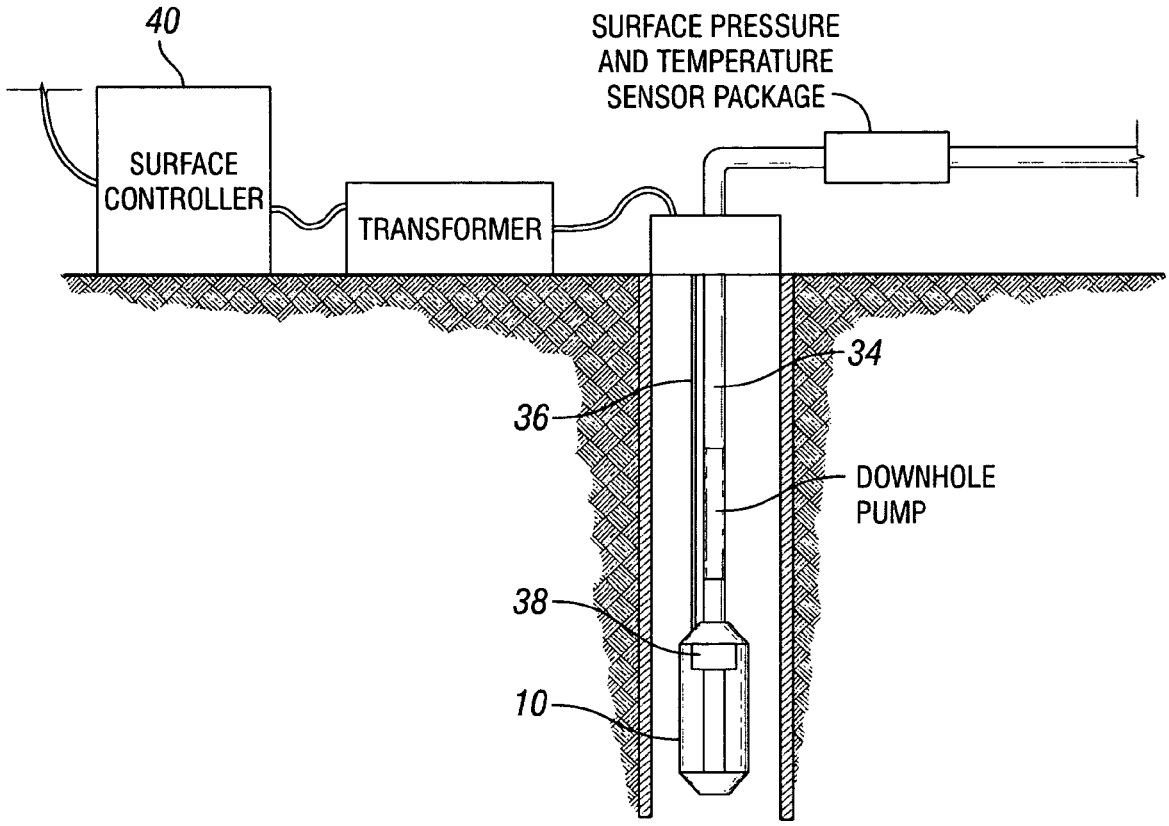
FIG. 4 illustrates a production system and a side view of a treatment apparatus for oil and gas production located at a lower point of the tubing string.
Figure 5:
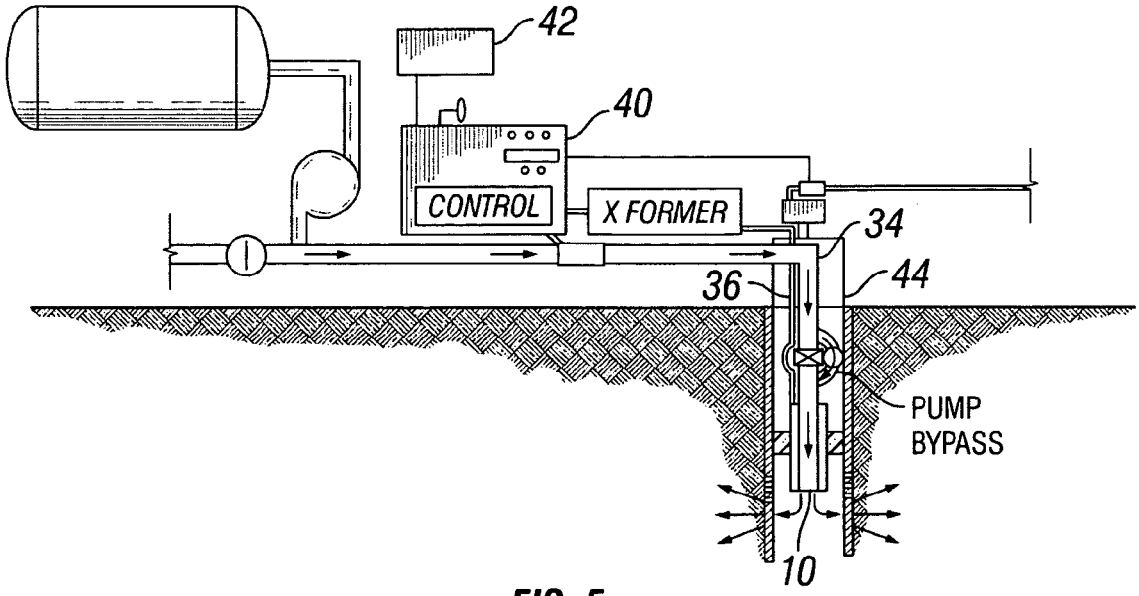
FIG. 5 illustrates a production system and a side view of a fluid injection system for oil and gas production including the apparatus at a lowermost point along of the tubing string.

As depicted in FIG. 3-5, this treatment apparatus 10 is preferably positioned at a point along the production tubing string 34 installed in the well, either at the lowest point in the tubing string (FIG. 4) or at some intermediate point (FIG. 3). As shown in FIGS. 3-5, power is supplied to the treatment apparatus 10 using known power cable 36 suitable for the applications. This power cable 36 is normally attached to the production tubing string 34 using steel bands.

As shown in FIG. 6, power is supplied to apparatus 10 from a power source 42 via power cable 36. In a particularly advantageous embodiment, at least one surface controller 40 is positioned at a point between the power source 42 and the well head 44, whereby power and other communication can be transferred from power source 42 to surface controller 40 and from surface controller 40 to well head 44 and ultimately to apparatus 10 via power cables 36. Under normal operating conditions, power cable 36 is attached to tubing string 34 using steel bands, although other means of connection are contemplated. The preferable steel bands that attach the cable to the production tubing are commonly used to attach electric submersible pump power cable. If necessary, a step-up transformer can also be installed between surface controller 40 and well head 44 to increase and level out the voltage applied to apparatus 10.

One or more downhole sensors 38 (temperature or pressure/temperature) are preferably installed near the outlet of the treatment apparatus 10 in order to measure the temperature of the fluid stream so that power supplied to the treatment apparatus 10 can be adjusted to achieve desired optimum results. Readings from the sensors 38 are delivered to the surface controller 40 either through the power cable 36 or by other means such as fiber optic lines, or wireless signals, including but not limited to microwave, cellular or radio signals. For production applications, sensors are preferably fixedly connected to apparatus 10 near an outlet toward apparatus top; while for injection applications, sensors are preferably fixedly connected to apparatus 10 at a lower position on apparatus 10. It is possible to operate the apparatus using a sensor mounted nearly anywhere in the tubing string, but it is preferable to locate the sensors on or near the apparatus 10.

As shown in FIG. 4, one or more downhole temperature and/or temperature/pressure sensors 38 can be installed downstream of heating member 11. Suitably, sensors 38 measure the temperature and/or pressure of fluid stream 5 so that the power supplied to apparatus 10 can be adjusted, if necessary, to achieve desired fluid stream 5 characteristics. In addition, more than one sensor 38 can be positioned at various points along the tubing string 34, from the bottom of the well to the stock tank, for either or both of production and injection processes. In some cases, such as when the treatment apparatus 10 is used both for production and for injection or when surface temperature and pressure are important, there multiple sensors 38 located at additional points along the fluid path from the bottom of the well to a stock tank are advantageous.

The surface controller 40 is preferably located between a power source 42 and the wellhead 44 and is connected using suitable known electric cable both from the power source and to the wellhead and downhole power cable 36. In most applications, a step-up transformer will also preferably be installed between the surface controller 40 and the wellhead 44 to increase the voltage at a constant ratio.

As shown in FIG. 4, alternative variations or methods of using the treatment apparatus 10 are contemplated. In this particular embodiment, the treatment apparatus 10 may be used in a production application such as with a free flowing, pumped, or gas lift well where the primary objective is to reduce fluid stream pressure losses, eliminate paraffin or hydrate deposits, or improve pump operating efficiency by lowering the fluid viscosity. In these applications, the treatment apparatus 10 may be located at the bottom of the tubing string 34 below the pump intake if one is used. The element may also be located elsewhere along the tubing string 34 such as near an operating gas lift valve (FIG. 3) or at the sea bed in an offshore installation in order to provide desired levels of heat to the fluid stream 5 at the most beneficial location. This downhole heating system may also be used as a form of artificial lift in applications where the fluid stream 5 contains sufficient levels of gas in solution and where this gas can be released of brought out of solution by heating to lower the specific gravity of the fluid stream and cause fluid to flow to the surface. In these applications, the downhole element may be located at multiple points where heating will provide the most effective level change in fluid specific gravity. Yet another preferable method of using the apparatus is in offshore applications, particularly in offshore applications, where the water temperature is typically very cold (or near freezing). In these instances, the device can be used (1) to heat fluid in sub sea flow lines to maintain low viscosity and decrease the pressure required to move fluid; and/or (2) installed in the production tubing string as described herein at the sea bed to offset temperature losses to the fluid stream caused by exposure to cold sea water surrounding the riser pipe.

In yet another embodiment, as depicted in FIG. 5 this treatment apparatus 10 may be used as a downhole heating system and may also be used in an injection application where the primary objective is to improve fluid delivery from the reservoir to the well bore by eliminating near well bore damage, lowering fluid viscosity in the reservoir or near well bore or other similar applications. In these applications, the downhole element may be located close to the casing perforations in order to minimize heat loss between the heating element and the formation.

This heating system may also be used to increase the temperature of the fluid stream 5 near the surface in order to reduce required well head pressure to deliver fluid from the well head to the stock tank or pipeline. In these applications, the heating element may be located in the well near the surface or even inside the surface production tubing on the surface.

This heating system may also be used in order to achieve some combination of the above applications in which case, it may be connected differently.

Apparatus 10 can be positioned at any point along tubing string 34, either at the lowest point in the tubing string 34, as shown in FIG. 4, or at any intermediate point in the tubing string 34, as shown in FIG. 3. In at least a second implementation, more than one apparatus 10 can be positioned at multiple points along production tubing string 34. During production, formation fluids first flow into the wellbore through perforations where fluid stream 5 is introduced to tubing string 34 or apparatus 10 and flows through and/or around apparatus 10 as the fluid stream 5 flows to the surface via tubing string 34.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

We claim:

1. A system for heating a fluid stream in a wellbore, said system comprising:

(a) a tubing string disposed in said wellbore, said tubing string comprised of a plurality of tubular members through which fluid can flow; and (b) a heating apparatus, said heating apparatus comprising a mixing section with an inlet and outlet, said outlet in fluid communication with a tubular member; and a heating section disposed adjacent said inlet of said mixing section, said heating section capable of generating heat for transfer to a fluid passing therethrough, (c) wherein said heating section comprises (i) an elongated, equiangular and equilateral polygonal heat transfer tube characterized by at least six flat contiguous sides and a plurality of radially disposed fins extending from said sides, said heat transfer tube having an inner surface and an outer surface and (ii) a tubular shroud surrounding said elongated heat transfer tube, wherein said heat transfer tube is co-axially mounted in said tubular shroud so as to form an annular space between said outer surface of said heat transfer tube and said shroud, thereby defining a first flowpath for said fluid stream, said inner surface of said heat transfer tube defining a second flowpath for said fluid stream;

(d) wherein said mixing section comprising a mixing chamber configured to cause said first and second flowpaths to converge, wherein said mixing chamber is surrounded by a tubular shroud co-axially disposed around said mixing chamber.

2. The system of claim 1, wherein said heating apparatus further comprises a plurality of axially aligned heating sections and mixing sections, alternatingly arranged in series.

3. The system of claim 1, wherein said heating apparatus is disposed in said tubing string between adjacent tubular members.

4. A system for heating a fluid stream in a wellbore, said system comprising:

(a) a tubing string disposed in said wellbore, said tubing string comprised of a plurality of tubular members through which fluid can flow; and (b) a heating apparatus, said heating apparatus comprising a mixing section with an inlet and outlet, said outlet in fluid communication with a tubular member; and a heating section disposed adjacent said inlet of said mixing section, said heating section capable of generating heat for transfer to a fluid passing therethrough, (c) wherein said heating section comprises (i) an elongated, polygonal heat transfer tube defined around a central, elongated axis, said heat transfer tube formed by at least six flat contiguous sides of the same width symmetrically placed about the central, elongated axis and a plurality of radially disposed fins extending from said sides, said heat transfer tube having an inner surface and an outer surface and (ii) a tubular shroud surrounding said elongated heat transfer tube, wherein said heat transfer tube is co-axially mounted in said tubular shroud so as to form an annular space between said outer surface of said heat transfer tube and said shroud, thereby defining a first flowpath for said fluid stream, said inner surface of said heat transfer tube defining a second flowpath for said fluid stream;

(d) wherein said mixing section comprising a mixing chamber configured to cause said first and second flowpaths to converge, wherein said mixing chamber is surrounded by a tubular shroud co-axially disposed around said mixing chamber.

* * * * *